United States Patent [19]

Purvis

[11] 4,184,294

[45] Jan. 22, 1980

[54] SEAL FOR AIR SUPPORTED ROOF STRUCTURES

[75] Inventor: Thomas A. Purvis, Sandusky, Ohio

[73] Assignee: The Standard Products Company, Cleveland, Ohio

[21] Appl. No.: 896,321

[22] Filed: Apr. 14, 1978

[51] Int. Cl.[2] ..... E04B 1/34

[52] U.S. Cl. ..... 52/2; 52/83; 52/747

[58] Field of Search ..... 52/2, 83, 81, 80, 400, 52/528, 747; 135/15 CF

[56] References Cited

U.S. PATENT DOCUMENTS

| | | | |
|---|---|---|---|
| 2,650,401 | 9/1953 | LaMond | 135/15 CF |
| 3,277,615 | 10/1966 | Marques | 52/2 |
| 3,422,589 | 1/1969 | Harrison | 52/528 |
| 3,564,784 | 2/1971 | Mollinger | 135/15 CF |
| 3,744,191 | 7/1973 | Bird | 52/2 |
| 3,866,374 | 2/1975 | Dallen | 52/400 |
| 3,918,233 | 11/1975 | Simpson | 52/81 |

FOREIGN PATENT DOCUMENTS

| | | | |
|---|---|---|---|
| 2144844 | 8/1973 | Fed. Rep. of Germany | 52/2 |

*Primary Examiner*—Ernest R. Purser
*Assistant Examiner*—Henry E. Raduazo
*Attorney, Agent, or Firm*—Harness, Dickey & Pierce

[57] ABSTRACT

A weather seal assembly for an air supported roof structure which has a plurality of flexible sheets forming roof panels whose edges are joined together by clamping assemblies comprising pairs of clamping members. The clamping assemblies are sealed by a plurality of cross-shaped sealing strips which are attached to the clamping assemblies and a plurality of flexible membranes each of which is congruent with perimeter of a roof panel. Each clamping member holds one edge of a membrane the opposite edge of which is reversely folded over the clamping member and inserted into a channel in the sealing strip.

15 Claims, 4 Drawing Figures

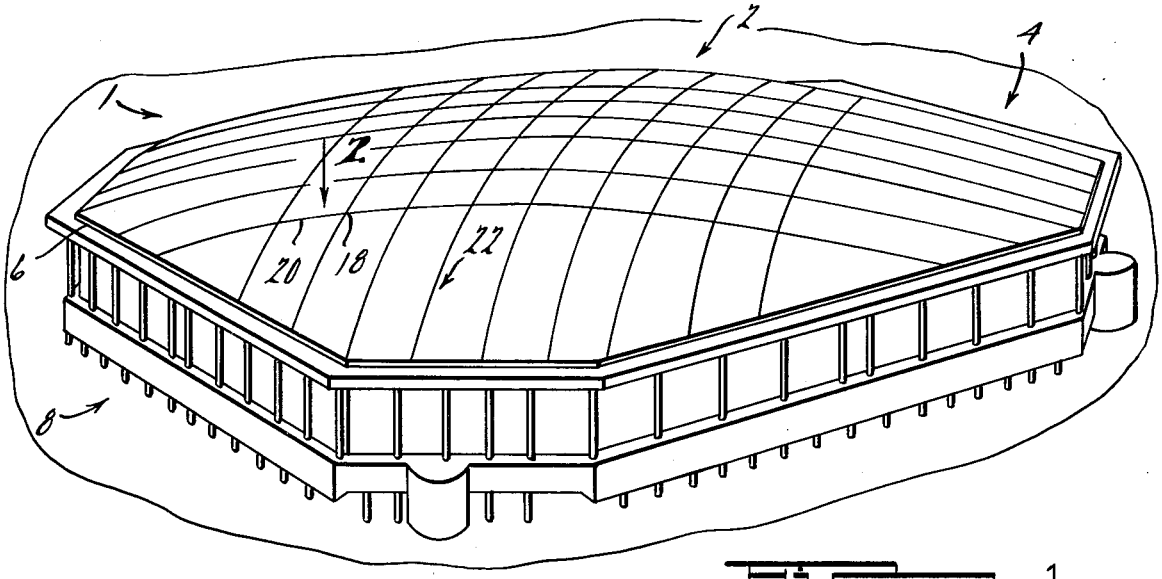
FIG. 1.
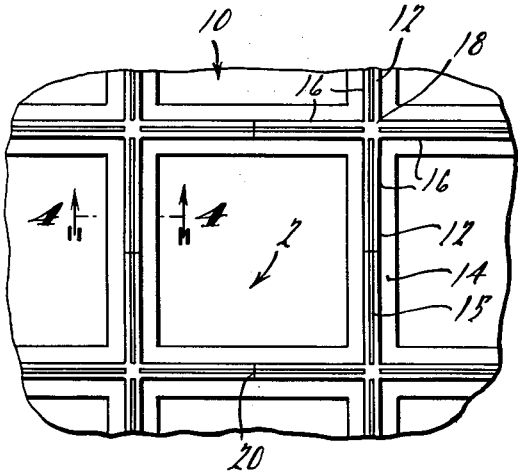
FIG. 2.
FIG. 3.
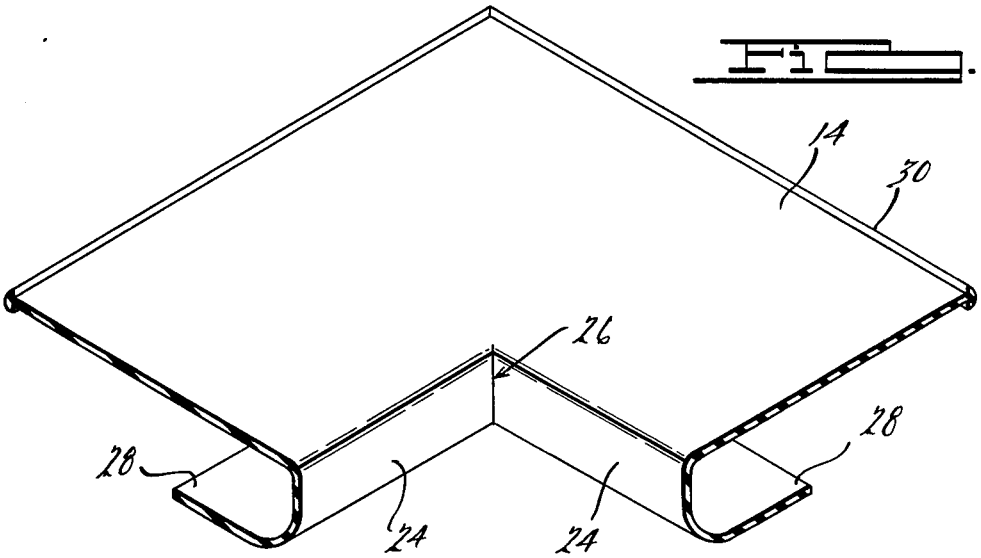

SEAL FOR AIR SUPPORTED ROOF STRUCTURES

BACKGROUND AND SUMMARY OF THE INVENTION

The present invention relates to the field of air supported roof structures and more particularly to whether sealing assemblies therefor and to a method of sealing air supported roof structures against the elements.

Conventional air supported roof structures are constructed from fiberglass reinforced fabric panels which are of modest dimensions and are generally quadrilateral in shape. These panels are fastened by clamps or other means to slack steel cables for structural support. When all panels are attached, a positive air pressure is provided inside the structure to inflate or lift the roof which is then characterized by a plurality of fabric panels supported upwardly by the positive interior air pressure and restrained by the steel cables to which they are attached. To insure the ability of the structure to inflate and remain inflated under the approximately 5 p.s.f. of air pressure conventionally employed, a substantially air tight seal must be accomplished between the edges of the panels. The seal must also be substantially weather resistant so that attacks by the elements such as rain, pooled water or snow loads will not destroy the air tight seal. It is, of course, also highly desirable that the integrity of the roof will be maintained so that no leaks will develop and detract from the protective function served by the roof structure.

One object of the weather sealing assembly of the present invention is to provide a weather seal which will maintain the integrity of an air supported roof against the elements. Another object of this invention is to provide a weather sealing assembly which will protect the metal clamping assembly including bolts, studs, washers and nuts associated therewith from the weather elements so that metals otherwise susceptible to weathering can be used in the clamping assembly. Still another object of this invention is to provide a weather seal assembly which is economical and easily installed. Yet another object is to provide a weather seal assembly which can be easily opened to allow repair work on the clamping assembly and then easily closed to again provide security against the elements.

These and other objects are achieved by the present invention which involves a weather seal assembly for an air supported roof structure having a plurality of flexible roof panels with edges joined by clamping assemblies having pairs of clamping members. The sealing assembly has a network of cross-shaped sealing strips attached to the clamping assemblies and flexible membranes, each of which is congruent with a roof panel. One edge of a membrane is fixedly retained by a clamping member while the other edge is reversely folded over the clamping member and retained within a channel in the sealing strip.

BRIEF DESCRIPTION OF THE DRAWING

FIG. 1 is a perspective view showing a sealing assembly of the present invention in operative association with an air supported roof structure;

FIG. 2 is a top plan view, not in proportion and broken away, of a sealing assembly of the present invention;

FIG. 3 is a perspective view, in section, of a flexible membrane of the sealing assembly of the present invention.

DESCRIPTION OF THE INVENTION

Figure 4:
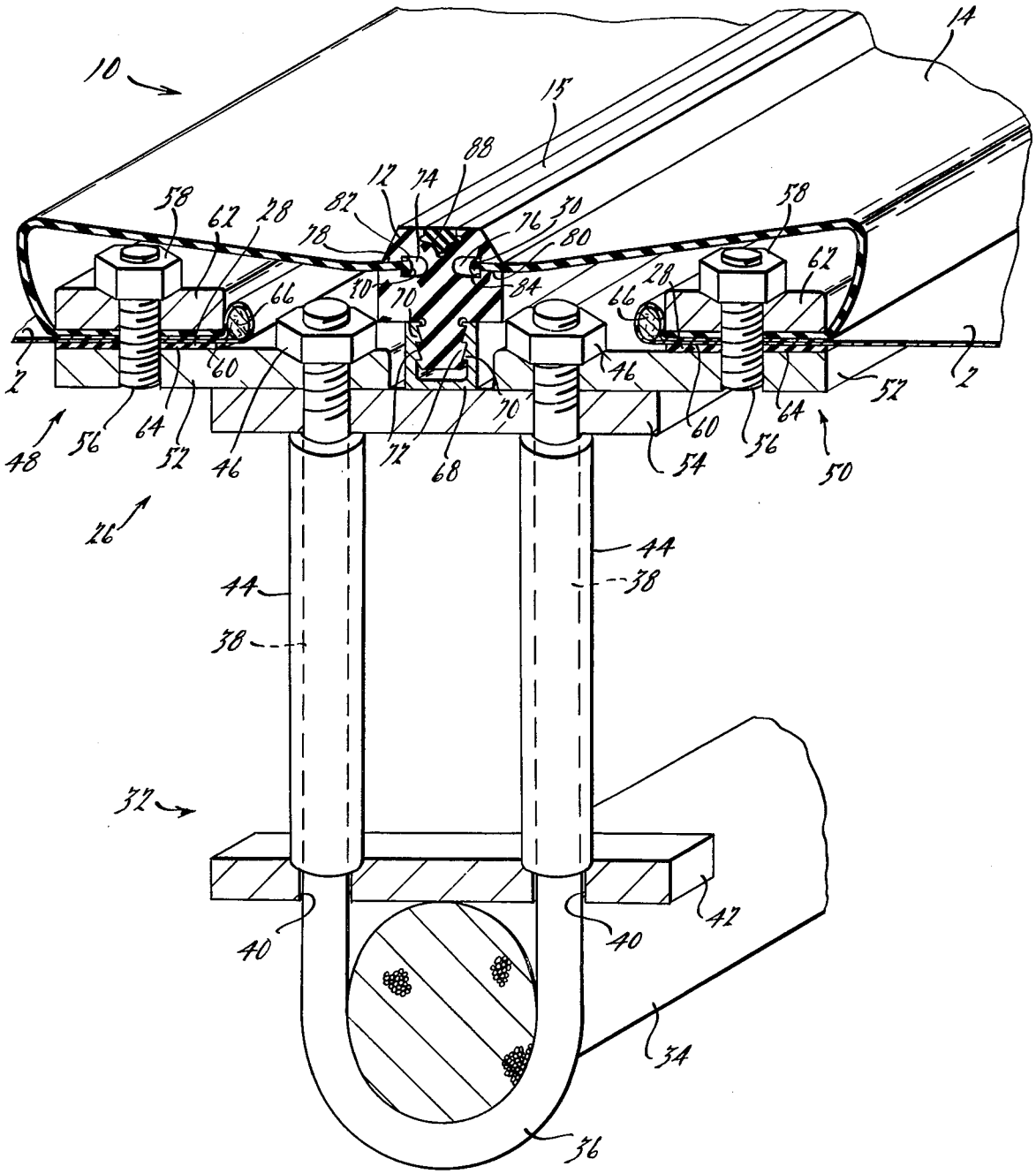
FIG. 4 is a cross-sectional view taken along lines 4—4 of FIG. 2, in perspective and broken away, of the sealing assembly of the present invention.

The present invention relates to a sealing assembly for sealing clamping assemblies used to hold together the flexible sheets forming the roof panels of air supported roof structures. As shown in FIG. 1, an air supported roof, indicated generally at 1, comprises a plurality of substantially square roof panels 2 which are often suspended above steel cables (not shown in FIG. 1) and which are joined together at their edges. Around the perimeter of air supported roof 1 are a plurality of irregularly shaped roof panels 4 having rectangular, trapezoidal or triangular shapes and adapted to form the part of the roof 1 proximate to and attached to the outside wall 6 of building 8.

As illustrated in FIG. 2, sealing assembly 10 of the present invention comprises a plurality of sealing strips 12 and flexible membranes 14 both of which are preferably made of a tough, weather-resistant, flexible but strong synthetic rubber such as neoprene. It will be appreciated by those skilled in the art that for illustrative purposes, FIG. 2 is not drawn to scale and roof panels 2 are much larger relative to sealing strips 12 and flexible membrane 14 than shown in the drawing. The exact sizes can vary within the scope of the present invention as can the shape of roof panels 2 which can be, for example, diamond-shaped.

Each sealing strip 12 is cross-shaped and has four integral legs 16. Thus, each leg 16 has one end integrally joined with the ends of three other legs 16 at intersection 18 and another end in abutting relationship with another leg 16 at a point 20 between intersections 18. Each leg 16 has a lock strip 15 to facilitate assembly and disassembly of sealing assembly 10 as explained further hereinafter. At the perimeter of air supported roof 1 where irregularly shaped panels 4 are used, legs 16 can be lengthened as at 22 as required to reach outside wall 6. Alternatively, a single leg 16 can be employed from outside wall 6 to abut against leg 16 of a cross-shaped sealing strip 12.

Each flexible membrane 14 is extruded, molded or otherwise formed to be one piece extending around the perimeter of a roof panel 2. In other words, each flexible membrane 14 is congruent with the perimeter edge portion of a roof panel 2. It is, of course, contemplated that flexible membranes will also be adapted for irregularly shaped roof panels 4. Such membranes can be congruent with the perimeter of each irregular roof panel 4 or can be congruent with only those edge portions adjacent to other roof panels, the edge portions adjacent to outside wall 6 being sealed by other, conventional means.

The structure of flexible membrane 14 can be further understood by referring to FIG. 3 which illustrates flexible membrane 14 in a folded position, i.e., the configuration it would have when in sealing engagement. Flexible membrane 14 has outer folds 24 intersecting at 26, outer edge portions 28, and flanges 30 along the inner edges thereof.

The operative and sealing relationships of flexible membrane 14 and cross-shaped sealing strip 12 will be further understood by referring to FIG. 4 which shows a sealing assembly 10 of the present invention in operative relationship with supporting cable assembly 32 and clamping assembly 26.

Supportive cable assembly 32 has steel cable 34, to which is attached U-bolt 36 having a pair of legs 38 which pass through holes 40 in aluminum plate 42. Legs 38 have spacers 44 thereon which are adapted to exert downward pressure on plate 42 to tighten U-bolt 36 about steel cable 34 when nuts 46 are tightened on the threaded ends of legs 38.

Clamping assembly 26 comprises a pair of clamping members indicated generally at 48 and 50 respectively. It will be appreciated that clamping member 48 is symmetrical to clamping member 50 and that the following description of clamping member 48 is fully applicable also to clamping member 50, like numbers being used to indicate identical parts in each clamping member. Clamping members 48 and 50 have elongated plates 52 supported on center elongated plate 54 and attached thereto by means of legs 38, spacers 44 and nuts 46. Of course, it will be apparent to those skilled in the art that an alternative embodiment of this invention could employ one integral supporting elongated plate functionally equivalent to elongated plates 52 and central elongated plate 54.

Along the outboard side of elongated plate 52 are a plurality of threaded studs 56 having nuts 58 thereon to clampingly hold edge portion 60 of roof panel 2 between elongated plate 52 and elongated clamping plate 62. As shown in FIG. 4 a sealing gasket 64 can be provided between edge portion 60 of roof panel 2 and elongated plate 52, and edge portion 60 of roof panel 2 can be rolled about a dowel 66 and reversely inserted between elongated plate 52 and elongated clamping plate 62 to prevent fraying and to insure that panel 2 is secured by clamping member 48.

The sealing assembly of the present invention comprises an elongated, channel-shaped receiver 68 which is fixedly attached to elongated plate 54 by welding or other means and which has a plurality of downward projecting ratchet teeth 70 on its interior walls. Seated in receiver 68 is elongated sealing strip 12 which has upwardly projecting ratchet teeth 72 adapted to engage and be retained by ratchet teeth 70 of receiver 68. Elongated sealing strip 12 also has side channels 74 and 76 adapted to receive edge flanges 30 of flexible membrane 14. Channels 74 and 76 have narrow necks 78 and 80 and shoulders 82 and 84 adapted to retain flanges 30 of flexible membrane 14 when lock strip 15 is in place in groove 88 along the top of sealing strip 12. Removal of lock strip 15 permits necks 78 and 80 of channels 74 and 76 to widen and allow removal of flanges 30 therefrom past shoulders 82 and 84. Outer edge portions 28 of flexible membranes 14 are secured by clamping members 48 and 50 between edge portion 60 of roof panel 2 and elongated clamping plate 62 by pressure exerted by elongated plate 52. As shown in FIGS. 3 and 4, outer edge portion 28 is reversely folded to provide an outer fold 24 and thereby to cover and protect the clamping assembly and underlying cable supporting assembly from the elements.

It is an advantage of the present invention that the weather seal assembly 10 can be easily installed and then later opened to effect repair on, for example, the clamping assembly. Thus, in accordance with the method of this invention, the weather seal assembly can be installed by clamping outer edge portions 28 of flexible membranes 14 in clamping members 48 and 50 and then reversely folding said flexible membranes 14 over clamping assemblies 48 and 50 to cover and protect each assembly. Each edge flange 30 of flexible membranes 14 is inserted into channel 74 or 76 on opposite sides of elongated sealing strip 12. Finally, lock strip 15 is inserted into groove 88 along the top of sealing strip 12 thereby causing necks 78 and 80 of channels 74 and 76 respectively to narrow and retain flanges 30 therein by means of shoulders 82 and 84.

For maintenance of clamping assembly 26, sealing assembly 10 can be opened by first removing lock strip 15 from groove 88, then removing flanges 30 from channels 74 and 76 and folding flexible membranes 14 open to expose the top of clamping members 48 and 50. After maintenance has been completed, sealing assembly 10 can be assembled again to protect clamping members 48 and 50 against weather elements by inserting flanges 30 of flexible membranes 14 into channels 74 and 76 and lock strip 15 into groove 88.

While a specific form of this invention has been described and illustrated herein, it is to be understood that the invention may be varied within the scope of the appended claims without departing from the spirit of the invention.

What is claimed is:

1. A weather seal for an air supported roof structure, said roof structure characterized by a plurality of flexible roof panels with edges joined together by clamping means, said weather seal comprising: an elongated sealing strip; a weather resistant flexible membrane having a first edge portion adapted to fit in and be removably secured by said elongated sealing strip and a second edge portion reversely folded under and adapted to be secured by said clamping means; and means for attaching said elongated sealing strip to said clamping means.

2. A weather seal as recited in claim 1 wherein said elongated sealing strip has a channel with a narrow neck portion having shoulders facing away from the channel opening and said flexible membrane has a flange on said first edge portion adapted to fit in said channel and be secured by said shoulders.

3. A weather seal as recited in claim 2 wherein said elongated sealing strip has a locking strip removably located in an elongated groove parallel to said channel, said locking strip being of sufficient size so that, when removed, said neck of said channel can be widened to facilitate removal of said flange on said first edge portion of said flexible membrane.

4. A weather seal as recited in claim 3 wherein said elongated sealing strip has a pair of said channels on opposite sides of said strip and wherein said weather seal comprises a pair of flexible membranes each having a first edge portion adapted to fit in and be removably secured by one of said pair of said channels and a second edge portion reversely folded under and adapted to be secured by said clamping means.

5. A weather seal as recited in claim 4 wherein said elongated sealing strip is attached to said clamping means by a channel shaped receiver having inwardly facing rachet teeth adapted to engage corresponding ratchet teeth on said elongated sealing strip, said receiver being fixedly attached to said clamping means.

6. A weather seal as recited in claim 5 wherein said clamping means comprises a pair of clamping members each having a pair of pads forced against each other by a fastener to form a pressure joint adapted to compressibly grip an edge portion of one of said panels and a second edge portion of one of said flexible membranes and wherein said receiver is disposed between said pair of clamping members.

7. A weather seal as recited in claim 6 wherein said flexible membrane and said sealing strip are made of weather resistant synthetic rubber.

8. A weather seal for an air supported roof structure, said roof structure characterized by a plurality of flexible sheets forming roof panels having edges joined together by clamping assemblies having pairs of pads forced against each other by fasteners to form pressure joints, said weather seal comprising: a plurality of molded, weather resistant cross-shaped sealing strips having four intersecting legs; a plurality of flexible membranes, each of said membranes being congruent with the perimeter of one of said flexible sheets and having one longitudinal edge portion adapted to fit in said pressure joint, a middle portion adapted to reversely bend over and cover said pressure joint and another longitudinal edge portion adapted to removably fit into said sealing strips; and means for attaching said sealing strips to said clamping assemblies.

9. A weather seal as recited in claim 8 wherein each leg of said cross-shaped sealing strip has a channel with a narrow neck portion having shoulders facing away from the channel opening and said flexible membrane has a flange on said longitudinal edge portion adapted to fit into said channel so that said flange is retained in said channel by said shoulders.

10. A weather seal as recited in claim 9 wherein each leg of said cross-shaped sealing strip has a locking strip removably located in a groove parallel to said channel, said locking strip being of sufficient size so that when removed, said neck of said channel can be widened to facilitate removal of said flange.

11. A weather seal as recited in claim 10 wherein each leg of said cross-shaped sealing strip has a pair of channels located on opposite sides thereof, each of said channels being adapted to removably secure a flange on a longitudinal edge portion of one of said membranes.

12. A weather seal as recited in claim 11 wherein said clamping assembly comprises a pair of clamping members and each leg of said cross-shaped sealing strip is attached to said clamping assembly by a channel-shaped receiver having inwardly facing ratchet teeth adapted to engage corresponding ratchet teeth on said leg of cross-shaped sealing strip, said receiver being fixedly attached to said clamping assembly between said pair of clamping members.

13. A weather seal as recited in claim 12 wherein said flexible membrane and said sealing strip are made of weather resistant synthetic rubber.

14. The method of weather-proofing an air supported structure having a plurality of flexible sheets forming roof panels and a plurality of clamping assemblies, each clamping assembly comprising a pair of clamping members, each of which is attached to the edge of a panel, said method comprising:

(A) attaching a first edge portion of a first flexible membrane to a first clamping member of a clamping assembly;

(B) reversely bending said first membrane over said first clamping member;

(C) attaching a first edge portion of a second flexible membrane to a second clamping member of said clamping assembly;

(D) reversely bending said second membrane over said second clamping member; and (E) removably securing a second edge portion of said second membrane and a second edge portion of said first membrane to said sealing strip, said sealing strip being parallel to and between the edges of the panels held by said clamping assembly, and said sealing strip being fixedly attached to said clamping assembly.

15. The method of claim 12 wherein said first and second membrane are secured to said sealing strip by means of edge flanges on said membranes which are removably retained in longitudinal channels on opposite sides of said sealing strip by means of an additional channel containing a locking strip.

* * * * *